US011428143B2

(12) United States Patent
Zhang

(10) Patent No.: US 11,428,143 B2
(45) Date of Patent: Aug. 30, 2022

(54) METHOD FOR OPERATING AN INTERNAL COMBUSTION ENGINE

(71) Applicant: Vitesco Technologies GmbH, Hannover (DE)

(72) Inventor: Hong Zhang, Munich (DE)

(73) Assignee: VITESCO TECHNOLOGIES GMBH, Hannover (DE)

( * ) Notice: Subject to any disclaimer, the term of this patent is extended or adjusted under 35 U.S.C. 154(b) by 0 days.

(21) Appl. No.: 17/050,092

(22) PCT Filed: Apr. 8, 2019

(86) PCT No.: PCT/EP2019/058769
§ 371 (c)(1),
(2) Date: Oct. 23, 2020

(87) PCT Pub. No.: WO2019/206610
PCT Pub. Date: Oct. 31, 2019

(65) Prior Publication Data
US 2021/0372315 A1 Dec. 2, 2021

(30) Foreign Application Priority Data
Apr. 26, 2018 (DE) ..... 10 2018 206 451.2

(51) Int. Cl.
*F01N 11/00* (2006.01)
*F01N 3/08* (2006.01)
*F01N 9/00* (2006.01)

(52) U.S. Cl.
CPC ..... *F01N 11/007* (2013.01); *F01N 3/0814* (2013.01); *F01N 9/00* (2013.01);
(Continued)

(58) Field of Classification Search
CPC ..... F01N 3/0814; F01N 9/00; F01N 2250/02; F01N 2560/021; F01N 2560/025
See application file for complete search history.

(56) References Cited

U.S. PATENT DOCUMENTS 6,301,878 B1 10/2001 Zhang ..... 60/274
6,363,715 B1 * 4/2002 Bidner ..... F02D 41/0235 60/274
(Continued)

FOREIGN PATENT DOCUMENTS

DE 198 52 244 12/1999 ..... F02D 41/14
DE 101 17 050 9/2002 ..... F02D 41/14
(Continued)

OTHER PUBLICATIONS

Search Report for International Application No. PCT/EP2019/058769, 13 pages, dated Jul. 7, 2019.
(Continued)

*Primary Examiner* — Matthew T Largi
(74) *Attorney, Agent, or Firm* — Slayden Grubert Beard PLLC

(57) ABSTRACT

Methods comprising: arranging a binary lambda sensor and a second sensor downstream of a catalytic converter; when the engine is run for the first time, using an initial lambda setpoint for closed-loop control; measuring the $NH_3$ value in the exhaust gas; simultaneously measuring the signal from the binary lambda sensor; if the $NH_3$ value lies above a first threshold value, reducing the lambda setpoint value of the binary lambda signal until the $NH_3$ value lies below the first threshold value or the binary sensor signal lies below a second threshold value; recording the corresponding binary sensor signal when the $NH_3$ value passes the first threshold value, for binary sensor signal setpoint value adaptation, as $V_{binary\text{-}left}$; and calculating the real lambda setpoint value.

6 Claims, 1 Drawing Sheet

(52) U.S. Cl.
CPC .... *F01N 2550/02* (2013.01); *F01N 2560/021* (2013.01); *F01N 2560/025* (2013.01); *F01N 2560/026* (2013.01)

(56) References Cited

U.S. PATENT DOCUMENTS

| | | | | |
|---|---|---|---|---|
| 2004/0103642 | A1 | 6/2004 | Rosel | 60/274 |
| 2008/0040018 | A1* | 2/2008 | Katoch | F02D 41/1458 701/103 |
| 2010/0204904 | A1* | 8/2010 | Miyashita | F02D 41/1441 701/103 |
| 2013/0074817 | A1* | 3/2013 | Fisher | F02D 41/266 123/674 |
| 2013/0138326 | A1* | 5/2013 | Andersson | F02D 41/1402 701/103 |
| 2020/0240345 | A1 | 7/2020 | Zhang | F02D 41/1441 |

FOREIGN PATENT DOCUMENTS

| | | | |
|---|---|---|---|
| DE | 10 2017 218 327 | 4/2019 | F01N 11/00 |
| EP | 2 599 985 | 6/2013 | F02D 41/14 |
| JP | 2008 175173 | 7/2008 | F02D 41/04 |
| WO | 2009 053814 | 4/2009 | F02D 41/1441 |

OTHER PUBLICATIONS

Office Action for DE Application No. 10 2018 206 451.2, 5 pages, dated Dec. 4, 2018.

Chinese Office Action, Application No. 201980028351.4, 11 pages, dated Oct. 11, 2021.

Korean Notice of Allowance, Application No. 2022029556704, 3 pages, dated Apr. 20, 2022.

* cited by examiner

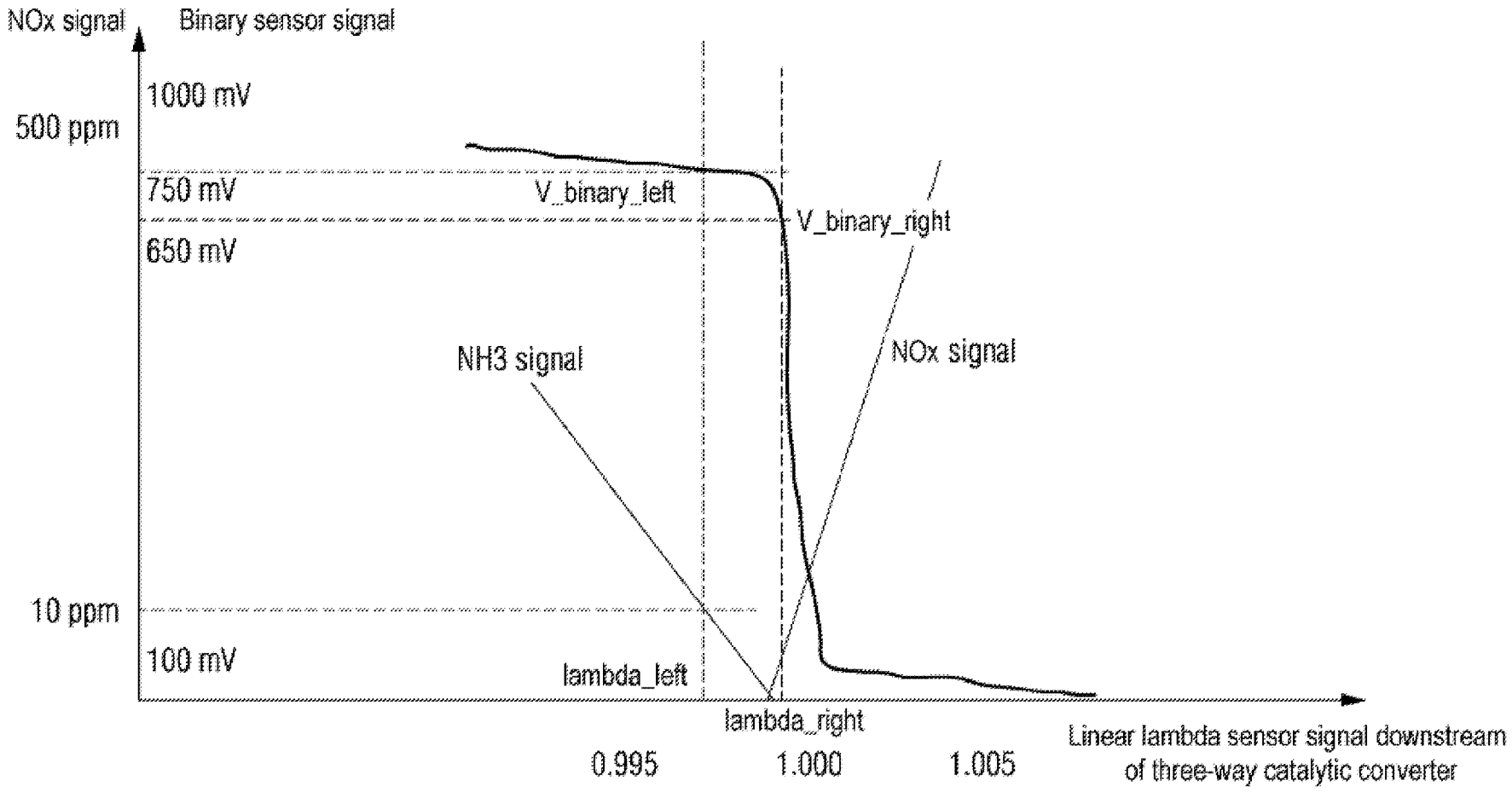
NOx signal
500 ppm
10 ppm
Binary sensor signal
1000 mV
750 mV
650 mV
100 mV
V_binary_left
V_binary_right
NH3 signal
NOx signal
lambda_left
lambda_right
0.995
1.000
1.005
Linear lambda sensor signal downstream of three-way catalytic converter

METHOD FOR OPERATING AN INTERNAL COMBUSTION ENGINE

CROSS-REFERENCE TO RELATED APPLICATIONS

This application is a U.S. National Stage Application of International Application No. PCT/EP2019/058769 filed Apr. 8, 2019, which designates the United States of America, and claims priority to DE Application No. 10 2018 206 451.2 filed Apr. 26, 2018, the contents of which are hereby incorporated by reference in their entirety.

TECHNICAL FIELD

The present disclosure relates to internal combustion engines. Various embodiments may include methods for operating an internal combustion engine, in the exhaust-gas tract of which a 3-way catalytic converter with closed-loop lambda control is arranged.

SUMMARY

The German patent application 10 2017 218 327.6 does not constitute a prior publication. Therein, a lambda setpoint value upstream of a 3-way catalytic converter, which is of importance for the closed-loop emissions control, is determined or established by combined measurement of a lambda value and of an $NH_3$ value by means of a $NO_x$ sensor with integrated lambda probe downstream of the 3-way catalytic converter. By precisely establishing this lambda setpoint value upstream of the 3-way catalytic converter, it is possible to keep lambda downstream of the catalytic converter in a precisely defined range, in order to minimize the $NO_x$ and $CO_2$/HC emissions. Below a threshold value of the electrical signal (binary signal) which represents the lambda value, the lambda setpoint value upstream of the 3-way catalytic converter is determined by the difference between the setpoint value of the electrical signal for the lambda value and the measured lambda value. Above a threshold value of the corresponding lambda signal, the lambda setpoint value upstream of the catalytic converter is however determined in a different way, specifically by means of the difference between an $NH_3$ setpoint value of the $NO_x$ sensor and the measured $NH_3$ signal of the $NO_x$ sensor. The $NH_3$ quantity occurring downstream of the 3-way catalytic converter is thus used for closed-loop control purposes.

The teachings of the present disclosure describe methods for operating an internal combustion engine with a 3-way catalytic converter and closed-loop lambda control, in which method the closed-loop lambda control can be performed particularly quickly and precisely. For example, some embodiments include a method comprising: arranging a binary lambda sensor and a $NO_x$ and/or $NH_3$ sensor downstream of the 3-way catalytic converter; when the internal combustion engine is run for the first time, setting a lambda setpoint value for the closed-loop control by means of the binary lambda sensor to an initial value; during the closed-loop lambda control with this setpoint value, measuring the $NH_3$ value in the exhaust gas downstream of the 3-way catalytic converter by means of a $NO_x$ signal or $NH_3$ signal from the $NO_x$ and $NH_3$ sensor; simultaneously measuring the binary sensor signal from the binary lambda sensor; if the $NH_3$ value lies above a first threshold value, reducing the lambda setpoint value of the binary lambda signal until the $NH_3$ value lies below the first threshold value or the binary sensor signal lies below a second threshold value; recording the corresponding binary sensor signal when the $NH_3$ value passes the first threshold value, for binary sensor signal setpoint value adaptation, as $V_{binary\text{-}left}$; and calculating the real lambda setpoint value for the closed-loop lambda control in accordance with the following equation:

$$V_{binary\ setpoint\ value}=a\times V_{binary\text{-}left}+(1-a)\times V_{binary\text{-}right} \quad (1)$$

where $V_{binary\text{-}left}$=binary sensor signal at the $NH_3$ limit in the rich direction for setpoint value adaptation $V_{binary\text{-}right}$=binary sensor signal closer to lambda 1 on the rich side a=weighting factor between 0 and 1.

BRIEF DESCRIPTION OF THE DRAWINGS

The teachings herein are explained in detail below with reference to an exemplary embodiment in conjunction with the drawing. The single FIGURE shows, in a diagram, the $NO_x$ and binary and linear lambda signals from a $NO_x$ sensor with an integrated lambda probe.

DETAILED DESCRIPTION

In some embodiments, there are separate sensors to be provided as the binary lambda sensor and $NO_x$ and/or $NH_3$ sensor. Rather, use may for example also be made of a $NO_x$ or $NH_3$ sensor with an integrated lambda probe. The weighting factor a used in equation (1) above, which lies between 0 and 1, may be selected as a function of the air mass flow. In most cases, this weighting factor is selected to be between 0.5 and 0.9. In the case of a large air mass flow, the weighting factor lies closer to 0.9 in order to prevent a $NO_x$ breakthrough.

In some embodiments, the closed-loop lambda control can be performed particularly quickly and precisely. Compliance with the desired emissions limits can be ensured over the service life of the internal combustion engine under varying conditions and even with an aged 3-way catalytic converter, with particularly low outlay in terms of calibration.

In some embodiments, the method according to the invention is furthermore distinguished by the fact that, every time the $NH_3$ signal passes the $NH_3$ threshold value (first threshold value) again during the operation of the internal combustion engine, the corresponding binary sensor signal is recorded again and used for a new setpoint value calculation in accordance with equation (1).

In some embodiments, the methods can be used for the setpoint value calculation of a linear lambda sensor signal downstream of the 3-way catalytic converter. Here, in order to achieve the abovementioned object, the teachings herein provides a method for operating an internal combustion engine, in the exhaust-gas tract of which a 3-way catalytic converter with closed-loop lambda control is arranged, which method comprises the following steps: arranging a linear lambda sensor and a $NO_x$ and/or $NH_3$ sensor downstream of the 3-way catalytic converter; when the internal combustion engine is run for the first time, setting a lambda setpoint value for the control by means of the linear lambda sensor to an initial value; during the closed-loop lambda control with this setpoint value, measuring the $NH_3$ value in the exhaust gas downstream of the 3-way catalytic converter by means of a $NO_x$ signal or $NH_3$ signal from the $NO_x$ and/or $NH_3$ sensor; simultaneously measuring a binary sensor signal and a linear sensor signal from the linear lambda sensor; if the $NH_3$ value lies above a first threshold value, increasing the lambda setpoint value of the linear lambda sensor signal until the $NH_3$ value lies below the first threshold value or the binary sensor signal lies below a second threshold value; recording the corresponding linear lambda sensor signal when the $NH_3$ value passes the first threshold value, for linear lambda setpoint value adaptation, as $Lambda_{left}$; if, initially, the binary sensor signal lies below a second threshold value, reducing the lambda setpoint value of the linear lambda sensor signal until the binary lambda signal lies above the second threshold value or the $NH_3$ signal lies above the first threshold value; recording the corresponding linear lambda sensor signal when the binary sensor signal passes the second threshold value, for linear lambda setpoint value adaptation, as $Lambda_{right}$; and calculating the real lambda setpoint value in accordance with the following equation:

$$Lambda_{setpoint\ value}=a\times Lambda_{left}+(1-a)\times Lambda_{right} \quad (2)$$

where $Lambda_{left}$=linear lambda sensor signal at the $NH_3$ limit in the rich direction for setpoint value adaptation, $Lambda_{right}$=linear lambda signal closer to lambda 1 on the rich side in the case of a binary sensor signal at the 2nd threshold value, a=weighting factor between 0 and 1.

It is not necessary for separate sensors to be provided as the linear lambda sensor and $NO_x$ and/or $NH_3$ sensor. Rather, use may for example also be made of a $NO_x$ or $NH_3$ sensor with an integrated lambda probe. The weighting factor a specified above may be selected as a function of the air mass flow. In most cases, the weighting factor is selected to be between 0.4 and 0.8. In the case of a large air mass flow, the weighting factor lies closer to 0.8 in order to prevent a $NO_x$ breakthrough.

In some embodiments, every time the $NH_3$ signal passes the $NH_3$ threshold value (first threshold value) during the operation of the internal combustion engine or the binary sensor signal passes the second threshold value, the corresponding linear lambda sensor signal is recorded again as $Lambda_{left}$ or $Lambda_{right}$ and used for a new setpoint value calculation in accordance with equation (2).

In some embodiments, the initial value of the lambda setpoint value is preferably 750 mV. The first threshold value ($NH_3$ value) is preferably 10 ppm, while the 2nd threshold value (binary sensor signal) is preferably 650 mV.

In some embodiments, the initial value of the lambda setpoint value is preferably 0.997. The first threshold value ($NH_3$ value) is preferably 10 ppm, while the second threshold value (binary signal) is preferably 650 mV.

In some embodiments, for on-board diagnosis, the $NO_x$ sensor signal at the lambda setpoint value is used for closed-loop control either with the binary sensor signal or with the linear lambda sensor signal. Here, if the correspondingly obtained value is above a third threshold value, the 3-way catalytic converter is classified as defective.

As discussed above, the teachings herein describe the adaptation of the binary sensor signal or linear lambda sensor signal downstream of the 3-way catalytic converter on the rich side (lambda<1) by means of a $NO_x$ or $NH_3$ sensor signal of the $NO_x$ and/or $NH_3$ sensor with subsequent determination of the lambda setpoint value either in the form of the binary sensor signal or lambda signal on the basis of the adapted signal for precise closed-loop lambda control downstream of the 3-way catalytic converter.

The FIGURE shows the linear lambda sensor signal downstream of the 3-way catalytic converter on the abscissa and the $NO_x$ signal and the binary sensor signal on the ordinate. In the above-described first method variant, the lambda setpoint value for closed-loop control with the binary lambda sensor downstream of the 3-way catalytic converter is set at an initial value of 750 mV. As described above, the $NH_3$ value downstream of the 3-way catalytic converter and the corresponding binary signal are then measured during the closed-loop lambda control with this setpoint value. If, here, the $NH_3$ value lies above 10 ppm, the lambda setpoint value of the binary sensor signal is reduced until the $NH_3$ value lies below 10 ppm or the binary sensor signal lies below 650 mV (second threshold value). The corresponding binary sensor signal when $NH_3$ passes the corresponding threshold value is recorded as $V_{binary\text{-}left}$.

Furthermore, the value $V_{binary\text{-}right}$ is acquired, which corresponds to the binary sensor signal closer to lambda on the rich side and which in this case is 650 mV. Then, from the equation given above, the corresponding binary setpoint value ($V_{binary\ setpoint\ value}$) is calculated with the aid of a weighting factor.

In some embodiments, the lambda setpoint value for closed-loop control with a linear lambda sensor downstream of the 3-way catalytic converter is set at an initial value of 0.997. The individual method steps are then carried out in the manner described above, wherein, here, a value of 10 ppm is taken as a basis as the first threshold value ($NH_3$ value) and a value of 650 mV is taken as a basis as the second threshold value (binary signal). The corresponding values $Lambda_{left}$ and $Lambda_{right}$ are ascertained in the manner described above. The lambda setpoint is calculated from equation (2) with the aid of the corresponding weighting factor.

The invention claimed is:

1. A method for operating an internal combustion engine, with a 3-way catalytic converter with closed-loop lambda control, the method comprising:

arranging a binary lambda sensor and a second sensor downstream of the 3-way catalytic converter, wherein the second sensor comprises at least one of an $NO_x$ and/or a $NH_3$ sensor;

when the internal combustion engine is run for a first time, setting a lambda setpoint value for the closed-loop control using the binary lambda sensor to an initial value;

during the closed-loop lambda control with the setpoint value, measuring an $NH_3$ value in the exhaust gas downstream of the 3-way catalytic converter by means of a $NO_x$ signal or a $NH_3$ signal from the $NO_x$ and/or $NH_3$ sensor at a first time;

measuring the signal from the binary lambda sensor at the first time;

if the $NH_3$ value lies above a first threshold value, reducing the lambda setpoint value of the binary lambda signal until the $NH_3$ value lies below the first threshold value or the binary lambda signal lies below a second threshold value;

recording the corresponding binary sensor signal when the $NH_3$ value passes the first threshold value, for a binary sensor signal setpoint value adaptation, as $V_{binary\text{-}left}$; and calculating a real lambda setpoint value for the closed-loop lambda control using:

$$V_{binary\ setpoint\ value}=a\times V_{binary\text{-}left}+(1-a)\times V_{binary\text{-}right} \quad (1)$$

where $V_{binary\text{-}left}$=a binary sensor signal at a $NH_3$ limit in a rich direction for setpoint value adaptation $V_{binary\text{-}right}$=a binary sensor signal closer to a lambda of 1 on a rich side a=a weighting factor between 0 and 1.

2. The method as claimed in claim 1, further comprising, every time the $NH_3$ signal passes the first $NH_3$ threshold value during operation of the internal combustion engine, recording the corresponding binary sensor signal again and performing a new setpoint value calculation in accordance with equation (1).

3. A method for operating an internal combustion engine with a 3-way catalytic converter with closed-loop lambda control, the method comprising:

arranging a linear lambda sensor and a second sensor downstream of the 3-way catalytic converter, wherein the second sensor comprises at least one of a $NO_x$ and/or a $NH_3$ sensor;

when the internal combustion engine is run for a first time, setting a lambda setpoint value for the closed-loop control using the linear lambda sensor to an initial value;

during the closed-loop lambda control with the initial value, measuring a $NH_3$ value in exhaust gas downstream of the 3-way catalytic converter using a signal from the second sensor at a first time;

measuring a binary sensor signal and a linear sensor signal from the linear lambda sensor at the first time;

if the $NH_3$ value lies above a first threshold value, increasing the lambda setpoint value of the linear lambda sensor signal until the $NH_3$ value lies below the first threshold value or the binary sensor signal lies below a second threshold value;

recording a corresponding linear lambda sensor signal when the $NH_3$ value passes the first threshold value, fora linear lambda setpoint value adaptation, as $Lambda_{left}$;

if, initially, the binary sensor signal lies below the second threshold value, reducing the lambda setpoint value of the linear lambda sensor signal until the binary lambda signal lies above the second threshold value or a $NH_3$ signal lies above the first threshold value;

recording the corresponding linear lambda sensor signal when the binary sensor signal passes the second threshold value, for the linear lambda setpoint value adaptation, as $Lambda_{right}$; and calculating a real lambda setpoint value in accordance with the following equation:

$$Lambda_{setpoint\ value}=a\times Lambda_{left}+(1-a)\times Lambda_{right} \quad (2)$$

where $Lambda_{left}$=linear lambda sensor signal at a $NH_3$ limit in a rich direction for the setpoint value adaptation, $Lambda_{right}$=linear lambda signal closer to a lambda of 1 on a rich side in a case of the binary sensor signal at the second threshold value, a=a weighting factor between 0 and 1.

4. The method as claimed in claim 3, further comprising, every time the $NH_3$ signal passes the first threshold value during the operation of the internal combustion engine or the binary sensor signal passes the second threshold value, recording a corresponding linear lambda sensor signal as $Lambda_{left}$ or $Lambda_{right}$ and using the sensor signal as a new setpoint value calculation in accordance with equation (2).

5. The method as claimed in claim 3, wherein, for an on-board diagnosis, the $NO_x$ sensor signal at the lambda setpoint value is used for closed-loop control either with the binary sensor signal or with the linear lambda sensor signal.

6. The method as claimed in claim 5, wherein, if a value obtained in accordance with claim 5 lies above a third threshold value, the 3-way catalytic converter is classified as faulty.

* * * * *